United States Patent [19]

Foster

[11] 4,005,814

[45] Feb. 1, 1977

[54] CARTON WITH INTEGRAL OVERWRAP

[75] Inventor: Thomas W. Foster, Palo Alto, Calif.

[73] Assignee: Fibreboard Corporation, San Francisco, Calif.

[22] Filed: June 3, 1976

[21] Appl. No.: 692,498

[52] U.S. Cl. ..... 229/39 R; 229/87 R

[51] Int. Cl.[2] ..... B65D 5/10; B65D 65/12; B65D 65/14

[58] Field of Search ..... 229/14 BL, 37 R, 38, 229/39 R, 87 R

[56] References Cited

UNITED STATES PATENTS

| | | | |
|---|---|---|---|
| 3,391,856 | 7/1968 | Siegler | 229/87 R |
| 3,443,739 | 5/1969 | Adams, Jr. | 229/87 R X |
| 3,451,611 | 6/1969 | Adams, Jr. | 229/87 R X |
| 3,459,358 | 8/1969 | Adams, Jr. | 229/87 R X |
| 3,460,738 | 8/1969 | Adams, Jr. et al. | 229/87 R X |
| 3,790,069 | 2/1974 | Straccamore | 229/87 R |
| 3,829,005 | 8/1974 | Hackenberg et al. | 229/14 BL |
| 3,851,815 | 12/1974 | Desmond et al. | 229/87 R |

*Primary Examiner*—Stephen P. Garbe
*Attorney, Agent, or Firm*—Robert A. Beck

[57] ABSTRACT

An overwrapped carton is formed from a suitably cut and scored paperboard carton blank integrally combined with a flexible overwrap. The carton blank has end closure flaps, one of which is trapezoidal and the overwrap is combined with the blank so that the carton may be set up in tubular form, filled with product and the end closures quickly and expeditiously closed to form a completely overwrapped carton.

4 Claims, 6 Drawing Figures

FIG. 1.
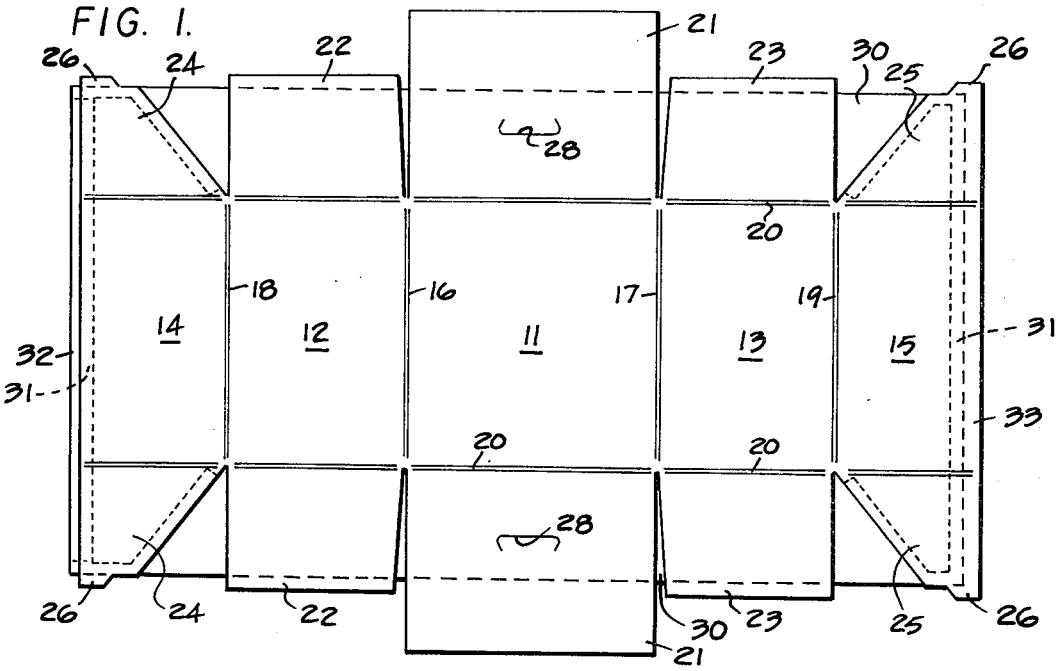
FIG. 2.
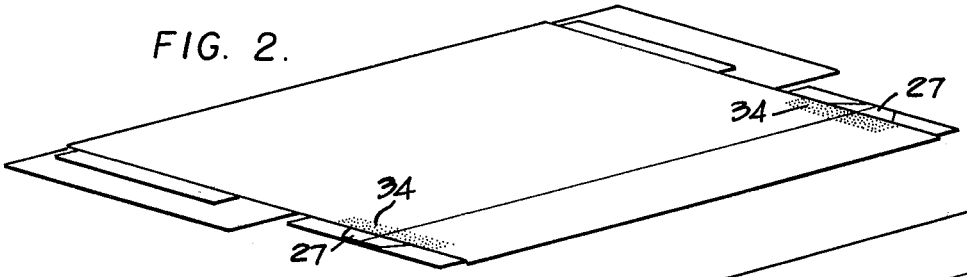
FIG. 3.
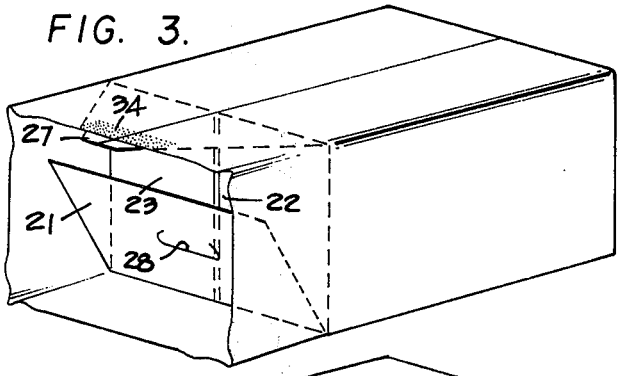
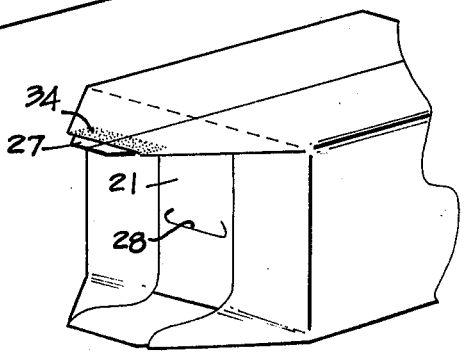
FIG. 4.
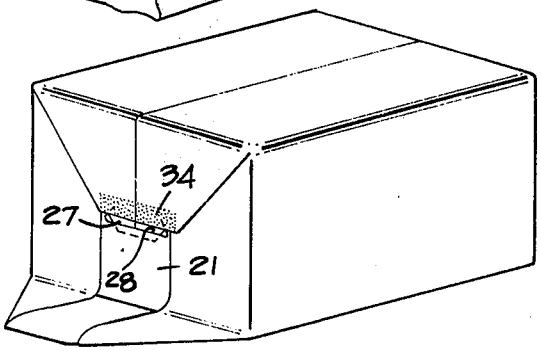
FIG. 5.
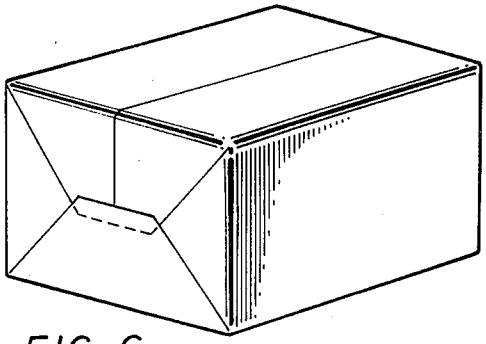
FIG. 6.

CARTON WITH INTEGRAL OVERWRAP

BACKGROUND OF THE INVENTION

During holiday seasons when gift giving is common, most department stores and the like maintain wrapping departments where decorative wrappers may be applied to customers' purchases. This operation is expensive and time consuming since the decorative overwrap must be cut to the proper size, folded about the box in which the purchase is contained and then attached thereto in a neat and attractive manner. The invention disclosed herein, a tubular carton combined with a decorative overwrap, obviates much of the time and expense involved in this operation. The carton need only be squared up into tubular form, the contents inserted and the ends folded in the manner prescribed to provide a decoratively overwrapped carton in one quick, efficient operation.

PRIOR ART

U.S. Pats. Nos. 2,479,456 to W. H. Arthur, class 229-14 and 3,394,867 to W. D. Gregg, class 229-37 each disclose a flat blank with an attached wrapper. Each blank is designed to be formed into a set-up box with a body portion and an attached lid portion. When the lid is closed, a wrapped carton is formed. U.S. Pat. Nos. 3,451,611 and 3,459,358, both to L. Adams, Jr. , class 229-37, and 3,851,815 to J. D. Desmond et al., class 229-87 disclose overwrapped cartons of square configuration suitable for containing a bottle; but each of these requires that the wrapper be cut, folded over and glued around certain of the end flaps. U.S. Pat. No. 3,257,068 to M. M. Wright, class 229-87, discloses an automatic bottom carton with an overwrap.

SUMMARY OF THE INVENTION

It is an object of the invention to provide a combination carton structure made from a paperboard carton blank and an integral decorative overwrap which may be quickly and expeditiously set up, filled, closed and sealed.

A paperboard carton blank comprises a bottom panel, side panels hinged to the sides of the bottom panel and a pair of top panel portions, one hinged to each side panel. Side end flaps are hinged to each end of each side panel, bottom end flaps are hinged to each bottom panel and a partial top end flap is hinged to each end of each top panel portion. When the top panel portions are attached to form a tubular carton structure, the two partial top end flaps together form a trapezoidally shaped top end flap at each end of the carton. These top end flaps may have tabs associated therewith which may cooperate with slits in the bottom end flaps to lock the flaps in closed position.

A thin, flexible, decorative overwrap is adhered to the outer surface of the carton blank, overlapping the outer of the two top panel portions along a free transverse edge so that when the two top panel portions are sealed together to form a tubular carton structure, the seam is covered by the decorative overwrap. The overwrap is adhered to the trapezoidal top end flaps but is not attached to the other end flaps. The overwrap extends longitudinally of the tubular carton to cover, at least in part, the end flaps so that when the ends are closed in the prescribed manner, the ends are completely and neatly covered by he decorative overwrap. A patch of pressure sensitive adhesive may be printed on the overwrap adjacent each end of the carton, and protected by removable silicone release paper, to assist in sealing the overwrap upon closure.

BRIEF DESCRIPTION OF THE DRAWINGS

The foregoing and other objects of the invention will become apparent from the following description and accompanying drawings wherein:

FIG. 1 is a plan view of a paperboard blank and attached overwrap adapted to be erected into a carton embodying the invention;

FIG. 2 depicts the blank of FIG. 1 folded and glued into a flat sleeve;

FIG. 3 is a perspective view of a tubular carton formed by erection of the flat sleeve, with the side end flaps folded and the bottom end flap partially folded;

FIG. 4 is a view similar to FIG. 3 with the overwrap partially folded, and partially broken away;

FIG. 5 is a view similar to FIG. 4 with the trapezoidal top end flap folded into closed position, and FIG. 6 is a perspective view of the completed end closure.

DETAILED DESCRIPTION OF PREFERRED EMBODIMENT

As shown in FIG. 1, the combination blank which may be used to form the carton of the invention comprises a cut and scored paperboard blank 10 combined with a thin, flexible, decorative overwrap 30. Carton blank 10 includes a bottom panel 11, side panels 12 and 13 hinged thereto along scorelines 16, 17 and top panel portions 14, 15 hinged to said side panels along scorelines 18, 19. It should be noted that the combined widths of top panel portions 14, 15 are greater than the widths of bottom panel 11 to provide for overlapping and gluing to form a completed top panel equal in width to bottom panel 11.

End flaps are hinged to each of the aforementioned panels along transverse scorelines 20, 20. Bottom end flaps 21, 21 are hinged to bottom panel 11, side end flaps 22, 22 and 23, 23 are hinged respectively to side panels 12, 13 and partial top end flaps 24, 24 and 25, 25 are hinged respectively to top panel portions 14, 15. These partial top end flaps are so formed that when the top panel portions are sealed together at their edges to form a completed top panel in the tubular carton structure, each completed top end flap is trapezoidal in shape with the longer base hinged to the completed top panel.

Protruding tab portions 26, 26 may be formed on partial top end flaps 24, 25, which may form closure tabs 27 when the completed top panel is formed. Slits 28, 28 in bottom end flaps 21 may cooperate with closure tabs 27 to close the ends of the erected carton. Thin, flexible decorative overwrap 30 may be formed of paper or the like and is preferably decorated on its exterior surface with pleasing display patterns, although it may, if desired, be of a single color. Overwrap 30 is adhered to the outer surface of carton blank 10 to form a single unitized structure. Overwrap 30 is adhered to blank 10 in the patterned areas indicated in FIG. 1 at 31, 31; that is along the free edges of partial top panels 14, 15 and along the free edges of partial top end flaps 24, 25. Other areas may be adhered, for example along scorelines 16, 17, 18 or 19 if desired, but the overwrap must not be adhered to bottom end flaps 21 and side end flaps 22, 23.

Referring again to FIG. 1, and considering the vertical direction as the width and the horizontal direction as the length, it can be seen that the width of overwrap 30 is substantially the same as the combined widths of partial top panel 14 plus associated partial top end flaps 24, 24. The length of overwrap 30 is substantially equal to the length of blank 10, but is offset to the left with respect thereto in FIG. 1 by an amount 32 which overlaps the free edge of partial top panel 14 and its associated end flaps. Also, overwrap 10 falls short of the free edge of partial top panel 15 by a similar amount 33.

In order to form this combined blank into the flat folded, tubular carton of FIG. 2, partial top panel 15 is first folded over along scoreline 19 into position overlying side panel 13. Adhesive is then applied to the blank in the area 33 which extends beyond overwrap 30. Thereafter, panels 12 and 14 are folded over along scoreline 16 until the edge area of panel 14 contacts the adhesively coated area 33 and is adhered thereto to form the flat folded tubular carton. It should be noted that overlapping area 32 of the overwrap will cover the seam to give a pleasing appearance.

The flat folded tubular carton of FIG. 2 may then be squared up into rectangular form, the contents inserted and the end closures completed in the manner shown in FIGS. 3 to 6. Since both end closures are formed in the same manner, only one is shown in the drawings.

The first step in this closing comprises folding inwardly of side end flaps 22, 23 to their closed positions at 90° angles to their respective side panels. Bottom end flap 21 is then folded upwardly and inwardly into face contacting relationship with flaps 22, 23. It should be noted that the closure is then essentially in the configuration of FIG. 3 except that bottom end flap 21 has been folded completely. Since overwrap 30 is not adhered to flaps 21, 22, 23, and since the completed trapezoidal top end flap to which the overwrap is adhered has not been folded, the overwrap portion of the end closure is not folded at all at this stage of the closure.

The next step in forming the end closure involves application of inward pressure to the side areas of the overwrap extensions to fold the sides of the overwrap inwardly into contact with the previously folded carton flaps. This pressure also causes the top portion of the overwrap extension to fold around the still unfolded trapezoidal top end flap. In addition, the applied pressure and the guiding forces from the folding of the overwrap around the trapezoidal shaped top end flap will cause the bottom portion of the overwrap extension to assume a trapezoidal shape similar to top end flap. The carton end closure will then be in the conformation of FIG. 4.

Only two steps are now required to complete the carton. First, the completed top end flap, along with the attached overwrap, is folded downwardly into contact with the partially completed closure. At this point, tab 27 on the top end flap may be inserted into slit 28 in bottom end flap 21 to hold it in position. Then, the trapezoidally shaped lower portion of the overwrap extension is folded upwardly into contact with the remainder of the end closure. The silicone release paper is then removed from a patch of pressure sensitive adhesive 34, printed on the exterior surface of the overwrap closely adjacent the edge thereof and adjacent the outer free edge of top end flap and the edge of the trapezoidally shaped lower portion of the overwrap extension is pressed there against to adhere the closure in closed position.

As can be seen from the foregoing, the specific combination disclosed of a paperboard carton and an integral decorative overwrap provides a structure which may be quickly and easily erected into tubular shape, filled with a product and easily closed and sealed to form a decoratively overwraped structure. The offset of the ovrwrap beyond the edge of the outer partial top panel covers the seam which completes the top panel and the extension of the overwrap ends beyond the body of the carton, with such extensions adhered only to a tapeziodial shaped end flap and free of attachment to other end flaps permits the ends to be rapidly and neatly closed and sealed together.

What is claimed is:

1. An overwraped carton structure of tubuar shape adapted to be end-loaded with a product and thereafter have the ends sealed, and formed from a cut and scored paperboard blank integrally combined with a flexible overwrap which completely covers carton structure;

said carton structure comprising a bottom panel, side panels and a top panel, bottom ends flaps and top ends flaps hinged respectively to each end of said panels and an end extension of said overwrap at each of said carton structure;

said top end flaps being of trapezoidal shape and said end extension of overwrap being adhered to said top end flaps but free of adherence of other flaps, and end closures at each end of said carton structure, said end closures comprising, in sequence, a. an infolded pair of side end flaps in closure position at 90° angles to said side panels, b. an infolded bottom end flap in face contacting relationship with said side end flaps, c. infolded sides areas of said overwrap extensions in face contacting relationship with said bottom end flap, d. an infolded top end flap with the adhered position of the overwrap extension, and e. an infolded bottom portion of the overwrap extension.

2. The carton structure of claim 1 said top panel is formed from a pair of top panel portions, said top end flaps are formed from a pair of top end flap portions, and seam formed by adhering said portions together to form the top panel and the top end flaps is covered by the overwrap.

3. The carton structure of claim 1 further comprising tab and slit means formed in said top end flap and said bottom end flap for locking said together.

4. The carton structure of claim 1 further comprising adhesive means on said overwrap for adhering said infolded bottom portion of the overwrap extension to that portion of the overwrap adhered to said top end flap.

* * * * *